US010227546B2

(12) United States Patent
Suen et al.

(10) Patent No.: US 10,227,546 B2
(45) Date of Patent: Mar. 12, 2019

(54) MULTIFUNCTIONAL MOLYBDENUM CONTAINING COMPOUNDS, METHOD OF MAKING AND USING, AND LUBRICATING OIL COMPOSITIONS CONTAINING SAME

(71) Applicant: Chevron Oronite Company LLC, San Ramon, CA (US)

(72) Inventors: Yat Fan Suen, Albany, CA (US); Julian H. McLain, San Ramon, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 190 days.

(21) Appl. No.: 15/348,070

(22) Filed: Nov. 10, 2016

(65) Prior Publication Data

US 2017/0058229 A1 Mar. 2, 2017

Related U.S. Application Data

(63) Continuation of application No. 14/741,748, filed on Jun. 17, 2015, now Pat. No. 9,534,186.

(51) Int. Cl.

| | |
|---|---|
| ***C10M 159/18*** | (2006.01) |
| ***C10M 141/06*** | (2006.01) |
| ***C10M 159/12*** | (2006.01) |
| ***C10M 177/00*** | (2006.01) |

(52) U.S. Cl.

CPC ..... *C10M 159/18* (2013.01); *C10M 141/06* (2013.01); *C10M 159/12* (2013.01); *C10M 177/00* (2013.01); *C10M 2201/062* (2013.01); *C10M 2227/066* (2013.01); *C10M 2227/09* (2013.01); *C10N 2230/06* (2013.01); *C10N 2230/10* (2013.01); *C10N 2240/10* (2013.01); *C10N 2240/102* (2013.01); *C10N 2240/104* (2013.01); *C10N 2270/00* (2013.01)

(58) Field of Classification Search

CPC ..... C10M 2201/062; C10M 2201/08; C10M 2201/081; C10M 2207/144; C10M 2215/042; C10M 2215/082; C10M 159/18; C10M 141/06; C10M 159/12; C10M 177/00; C10M 2227/066; C10M 2227/09; C10N 2210/06; C10N 2230/10; C10N 2240/102; C10N 2270/00; C10N 2240/104; C10N 2240/10; C10N 2230/06

See application file for complete search history.

(56) References Cited

U.S. PATENT DOCUMENTS

| | | | | |
|---|---|---|---|---|
| 4,085,126 | A | 4/1978 | McConnell et al. | |
| 4,116,986 | A | 9/1978 | Bistline, Jr. et al. | |
| 4,164,473 | A * | 8/1979 | Coupland | C07F 11/005 44/367 |
| 4,647,388 | A | 3/1987 | Schreiber | |
| 4,889,647 | A * | 12/1989 | Rowan | C07F 11/005 508/367 |
| 5,468,891 | A * | 11/1995 | Udding | C07F 11/005 556/61 |
| 7,479,473 | B2 | 1/2009 | Queen | |
| 9,534,186 | B1 * | 1/2017 | Suen | C10M 141/06 |
| 2007/0073073 | A1 | 3/2007 | Gershon et al. | |
| 2009/0156443 | A1 * | 6/2009 | Xu | C10M 159/18 508/272 |

FOREIGN PATENT DOCUMENTS

| | | |
|---|---|---|
| CN | 102533362 | 5/2014 |
| JP | 2009227919 | 10/2008 |

OTHER PUBLICATIONS

American Petroleum Institute (API) Publication 1509, Seventeenth Edition, Sep. 2012.

A. Sequeria, Jr., "Lubricant Base Oil and Wax Processing," New York, Marcel Decker, Chapter 6, (1994).

D.V. Brock, Lubrication Engineering, vol. 43, pp. 184-185, (1987).

* cited by examiner

*Primary Examiner* — Pamela H Weiss

(74) *Attorney, Agent, or Firm* — Carlton Virassammy

(57) ABSTRACT

Disclosed is a lubricating oil composition comprising the reaction product of a nitrogen containing reactant wherein the nitrogen containing reactant comprises an alkyl di-alkanolamide, an alkyl di-alkanolamine, or mixtures thereof; an acidic molybdenum compound; and a salicylate compound.

Also disclosed is a method for operating an internal combustion engine comprising said lubricating composition and a method for preparing a molybdenum containing friction modifier.

7 Claims, No Drawings

MULTIFUNCTIONAL MOLYBDENUM CONTAINING COMPOUNDS, METHOD OF MAKING AND USING, AND LUBRICATING OIL COMPOSITIONS CONTAINING SAME

BACKGROUND OF THE INVENTION

Technical Field

This invention relates to new lubricating oil additives and lubricating oil compositions comprising the new lubricating oil additives. More specifically, it relates to passenger car engines and heavy duty diesel engines having lubricating oil compositions containing a friction reducing component comprising a salicylate compound that is molybdated with a bis-alkoxy alkyl/alkenyl amide/amine.

Description of the Related Art

While motor vehicle manufacturers continue to seek improved fuel economy through engine design, new approaches in formulating engine oils have played an important role in improving fuel economy and have resulted in improved emission characteristics of motor vehicles. Lubricant optimization is especially preferred over engine hardware changes, due to its comparative lower cost per unit in fuel efficiency and possibility for backward compatibility with older engines. Therefore, formulators are under continued pressure to develop engine oils and additive packages which take advantage of new performance basestocks and additive blends which demonstrate better fuel efficiency, oxidative stability, volatility, and improved viscosity index (to name a few characteristics) over conventional formulations. To improve fuel efficiency, there has been a drive to use lower viscosity engine oils, which often requires new additive package formulations. High on the list of requirements for these new formulated engine oil specifications are those employing components which improve the frictional properties of the lubricating oil composition. In this case, the additive system design is the crucial factor and close attention must be focused on the additive/additive and additive/base fluid interactions.

Engine oil acts as a lubricant between moving engine parts at various conditions of load, speed and temperature. Hence, the various engine components experience different combinations of boundary layer, mixed and (elasto) hydrodynamic regimes of lubrication. The largest frictional losses are at piston liner/piston ring interface, and a smaller part by the bearing and valve train. To reduce the energy losses due to friction of the various parts and to prevent engine wear, additives are incorporated into the engine oil such as friction modifiers, anti-wear agents, and antioxidants. The latter tends to lengthen the effect of the afore mentioned additives. Also, to reduce the hydrodynamic friction in the piston/cylinder, the viscosity of engine oils has been lowered. This has increased the dependence on friction modifiers to offset the new boundary layer regime. Hence, a vast amount of effort has focused on the interaction of oil viscosity with various friction modifiers to improve fuel economy.

Friction modifiers have been around for several years for application in limited slip gear oils, automatic transmission fluids, slideway lubricants and multipurpose tractor fluids. With the desire for increased fuel economy, friction modifiers have been added to automotive crankcase lubricants and several are known in the art. They generally operate at boundary layer conditions at temperatures where anti-wear and extreme pressure additives are not yet reactive by forming thin mono-molecular layers of physically adsorbed polar oil-soluble products or reaction layers which exhibit a significantly lower friction compared to typical anti-wear or extreme pressure agents. However, under more severe conditions and in mixed lubrication regime these friction modifiers are added with an anti-wear or extreme pressure agent. The most common type is a zinc dithiophosphate (ZnDTP or ZDDP), which, due to emissions considerations, has been reduced in concentration in many current formulations.

Molybdenum is a multifunctional additive that can act as an antioxidant, anti-wear, and friction modifier in lubricant oils. To incorporate molybdenum metal in oil soluble form has always been a challenge for additive chemists. The desire is to obtain a molybdenum containing compound with high molybdenum content and low viscosity so that it is easy to blend. Typical organo-molybdenum compounds include molybdenum dithiocarbamates (MoDTC), molybdenum dithiophosphates (MoDTP), molybdenum amines, molybdenum alcoholates, and molybdenum alcohol-amides.

Japanese Patent Application Number 2009227919 discloses a lubricant composition containing a reaction product of higher carboxylic acid diethanol amine and molybdenum oxide, and reaction product of higher carboxylic acid monoglycerol ester and molybdenum oxide, fatty amine compound and ester compound.

U.S. Pat. No. 4,647,388 discloses a lubricant additive that is the reaction product of a salt of a tertiary amine which has polyethylene oxide residues and ammonium molybdate and/or $MoO_3$.

U.S. Pat. No. 4,889,647 discloses Mo complexes prepared by reacting fatty oil with diethanolamine (DEA) and a molybdenum source.

Chinese Patent Application Number 102533362, teaches an antioxidant containing an alkanolamide and molybdenum source.

U.S. Patent Application Number 20070073073 discloses a process for preparation of 2,4-heteroatom-substituted molybdena-3,3-dioxocycloalkane compounds.

SUMMARY OF THE INVENTION

In accordance with one embodiment of the present invention, there is provided a lubricating oil composition comprising the reaction product of:

a. a nitrogen containing reactant, wherein the nitrogen containing reactant comprises an alkyl di-alkanolamide, an alkyl di-alkanolamine, or mixtures thereof,
b. an acidic molybdenum compound; and
c. a salicylate compound.

Also provided is a method for operating an internal combustion engine comprising said lubricating composition and a method for preparing a molybdenum containing friction modifier

Definitions

Prior to discussing the invention in further detail, the following terms will be defined. As used herein, the following terms have the following meanings, unless expressly stated to the contrary.

The term "a major amount" of a base oil refers to where the amount of the base oil is at least 40 wt. % of the lubricating oil composition. In some embodiments, "a major amount" of a base oil refers to an amount of the base oil more than 50 wt. %, more than 60 wt. %, more than 70 wt. %, more than 80 wt. %, or more than 90 wt. % of the lubricating oil composition.

In the following description, all numbers disclosed herein are approximate values, regardless whether the word "about" or "approximate" is used in connection therewith. They may vary by 1 percent, 2 percent, 5 percent, or, sometimes, 10 to 20 percent.

DETAILED DESCRIPTION OF THE PREFERRED EMBODIMENTS

In an aspect, the present invention provides a molybdenum containing friction modifier. In an embodiment, the invention provides a composition comprising the reaction product of a (a) nitrogen containing reactant, wherein the nitrogen containing reactant comprises an alkyl di-alkanolamide, an alkyl di-alkanolamine, or mixtures thereof, (b) an acidic molybdenum compound; and (c) a salicylate compound.

Nitrogen-Containing Reactant

Alkanolamides

In one embodiment, the nitrogen-containing reactant is an alkyl di-alkanolamide. Such alkyl di-alkanolamides include, but are not limited to, di-ethanolamides derived from coconut oil. Typically, the alkyl group in coconut oil comprises mixtures of caprylyl, capryl, lauryl, myristyl, palmityl stearyl, oleyl and linoleyl.

Typically, alkyl di-alkanolamides are prepared by reacting carboxylic acids and esters with di-alkanolamines. Alkyl di-alkanolamides may be prepared from individual $C_2$-$C_{30}$ carboxylic acids—such as myristoleic acid, palmitoleic acid, oleic acid, linolenic acid, caproic acid, caprylic acid, capric acid, lauric acid, myristic acid, palmitic acid, stearic acid, arachidic acid, behenic acid, lignoceric acid, and the like—or their methyl esters as, for example, decanoic, lauric, myristic, palmitic, stearic, and oleic, or mixtures of alkyls such as those derived from animal fats or vegetable oils, that is, tallow, coconut oil, palm oil, palm kernel oil, fish oils, etc. These can readily be reacted with a variety of dialkanolamines to produce the desired alkyl di-alkanolamides. The alkyl di-alkanolamides may be prepared according to methods that are well known in the art, including, but not limited to, the process described in U.S. Pat. No. 4,085,126; U.S. Pat. No. 4,116,986; and U.S. Pat. No. 8,901,328, the disclosures of which are incorporated herein by reference.

In one embodiment, the nitrogen-containing reactant is an alkyl di-alkanolamide having the following formula (I):

(Formula I)

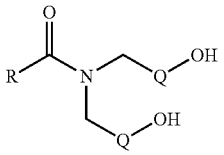

where R comprises 1 to 30 carbon atoms; preferably wherein R comprises 6 to 22 carbon atoms; more preferably, where R comprises from about 8 to about 18 carbon atoms and where Q is a $C_1$ to $C_4$ linear or branched alkylene group. In one embodiment, R comprises 17 carbon atoms. In another embodiment, R comprises 11 carbon atoms.

In one embodiment, the di-alkanolamide comprises a bis-ethoxy alkylamide. For example, the bis-ethoxy alkylamide has the following formula (II):

(Formula II)

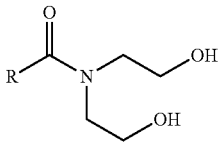

where R comprises 1 to 30 carbon atoms; preferably where R comprises 6 to 22 carbon atoms; more preferably, where R comprises from about 8 to about 18 carbon atoms. In one embodiment, R comprises 17 carbon atoms. In another embodiment, R comprises 11 carbon atoms.

Alkanolamines

In one embodiment, the nitrogen-containing reactant is an alkyl di-alkanolamine. Such alkyl di-alkanolamines include, but are not limited to, di-ethanolamines derived from coconut oil. Typically, the alkyl group in coconut oil comprises mixtures of caprylyl, capryl, lauryl, myristyl, palmityl stearyl, oleyl and linoleyl.

In one embodiment, the nitrogen-containing reactant is an alkyl di-alkanolamine having the following formula (III):

(Formula III)

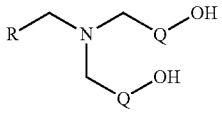

where R comprises 1 to 30 carbon atoms; preferably wherein R comprises 6 to 22 carbon atoms; more preferably, where R comprises from about 8 to about 18 carbon atoms and where Q is a $C_1$ to $C_4$ linear or branched alkylene group. In one embodiment, R comprises 17 carbon atoms. In another embodiment, R comprises 11 carbon atoms.

In one embodiment, the di-alkanolamine comprises a bis-ethoxy alkylamine. For example, the bis-ethoxy alkylamine has the following formula (IV):

(Formula IV)

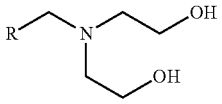

where R comprises 1 to 30 carbon atoms; preferably where R comprises 6 to 22 carbon atoms; more preferably, where R comprises from about 8 to about 18 carbon atoms. In one embodiment, R comprises 17 carbon atoms. In another embodiment, R comprises 11 carbon atoms.

The alkyl group of the di-alkanolamides and di-alkanolamines can have varying levels of unsaturation. For example, the alkyl group can comprise double and triple bonds.

Typically, alkyl di-alkanolamines are commercially available from Akzo Nobel. For example, products sold under the tradename Ethomeen® C/12 or Ethomeen® O/12 are suitable di-alkanolamines for use in the present invention.

Examples of alkyl alkanolamines include but are not limited to the following: Oleyl diethanolamine, dodecyl diethanolamine, 2-ethylhexyl diethanolamine, diethanolamine derived from coconut oil and diethanolamine derived from beef tallow and the like.

The nitrogen-containing reactant may be prepared by methods that are well known in the art. Alkyl di-alkanolamides and alkyl di-alkanolamines may be prepared according to U.S. Pat. No. 4,085,126; U.S. Pat. No. 7,479,473 and other methods that are well known in the art; or, they may be purchased from Akzo Nobel.

Acidic Molybdenum Compounds

The acidic molybdenum compounds or salts of thereof of the present invention include, but are not limited to, molybdenum trioxide, molybdic acid, ammonium molybdate, sodium molybdate, potassium molybdate and other alkaline metal molybdates and other molybdenum salts such as hydrogen salts, e.g., hydrogen sodium molybdate, $MoOCl_4$, $MoO_2Br_2$, $Mo_2O_3Cl_6$, or similar acidic molybdenum compounds. Generally, these molybdenum compounds are hexavalent. In one embodiment, the acidic molybdenum compound is selected from molybdenum trioxide, molybdic acid, ammonium molybdate, and alkali metal molybdates. In another embodiment, the acidic molybdenum compound is molybdenum trioxide.

Salicylate Compound

The salicylate compound of the present invention has the following formula (V):

(Formula V)

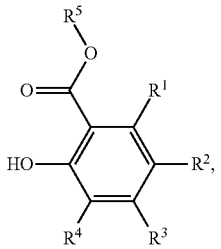

wherein $R^1$, $R^2$, $R^3$, and $R^4$ are each independently selected from the group consisting of hydrogen atom, $C_1$-$C_{40}$ alkyl group, carbocyclic group, heterocyclic group, nitro group, alkoxy group, hydroxy group, nitrile group, thiol group, amide group, amino group, keto group, and ester group; $R^5$ is a hydrogen atom or $C_1$-$C_{18}$ alkyl group. In an embodiment, $R^2$ and/or $R^4$ is a $C_1$-$C_{40}$ alkyl group. In an example, $R^1$, $R^2$, $R^3$, and $R^4$ are all hydrogen atoms. In another example, $R^2$ and $R^4$ are both isopropyl groups. In yet another example, $R^5$ is a methyl group.

Thus, in an aspect the present invention provides a lubricating oil composition comprising (a) a major amount of base oil of lubricating viscosity; and (b) the reaction product of (i) a nitrogen containing reactant, wherein the nitrogen containing reactant comprises an alkyl di-alkanolamide, an alkyl di-alkanolamine, or mixtures thereof, (ii) an acidic molybdenum compound; and (iii) a salicylate compound.

In an aspect, the present invention provides a method for operating an internal combustion engine comprising lubricating said engine with a lubricating oil composition comprising: (a) a major amount of base oil of lubricating viscosity; and (b) the reaction product of (i) a nitrogen containing reactant, wherein the nitrogen containing reactant comprises an alkyl di-alkanolamide, an alkyl di-alkanolamine, or mixtures thereof, (ii) an acidic molybdenum compound; and (iii) a salicylate compound.

In yet another aspect, the present invention provides a method for preparing an molybdenum containing friction modifier comprising, forming a aqueous reaction mixture comprising:

(a) a nitrogen containing reactant comprising a compound having the formula (I) and/or formula (III), (Formula I)

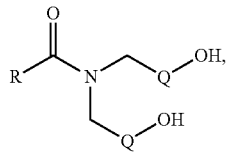

(Formula III)

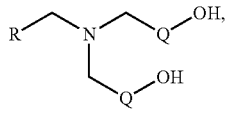

wherein each R individually comprises 1 to 30 carbon atoms; preferably wherein R comprises 6 to 22 carbon atoms; preferably wherein R comprises from about 8 to about 18 carbon atoms, and wherein Q is a $C_1$ to $C_4$ linear or branched alkylene group, (b) an acidic molybdenum compound; and (c) a salicylate compound having the formula (V);

(Formula V)

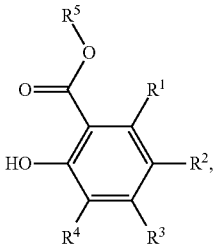

wherein $R^1$, $R^2$, $R^3$, and $R^4$ are each independently selected from the group consisting of hydrogen atom, $C_1$-$C_{40}$ alkyl group, carbocyclic group, heterocyclic group, nitro group, alkoxy group, hydroxy group, nitrile group, thiol group, amide group, amino group, keto group, and ester group; $R^5$ is a hydrogen atom or $C_1$-$C_{18}$ alkyl group; for a time and temperature sufficient to form said molybdenum containing friction modifier. In an embodiment, $R^2$ and/or $R^4$ is a alkyl group. In an example, $R^1$, $R^2$, $R^3$, and $R^4$ are all hydrogen atoms. In another example, $R^2$ and $R^4$ are both isopropyl groups. In yet another example, $R^5$ is a methyl group.

The acidic molybdenum compound is added in a sufficient quantity to yield 0.1 to 20, preferably 3.0 to 9.0, optimally about 4.0 to about 6.0 percent of molybdenum per total product.

The molybdenum containing friction modifiers are made by a condensation reaction. The oil soluble/dispersible nitrogen containing reactant and salicylate compound can be molybdated by adding the acidic molybdenum compound (e.g. molybdenum trioxide) to at least one of the oil soluble/dispersible nitrogen containing reactants; in a suitable reaction vessel under aqueous conditions and heating the resulting reaction mixture. The reaction is conducted at elevated temperature to accelerate the reaction and facilitate the removal of water from the reaction. The removal of this water is facilitated by either by use of an inert gas, such as nitrogen, contacting the surface of the reaction mixture or by conducting the reaction at reduced pressure. The temperature for conducting the molybdation reaction can vary. They can vary, for example, based on the reactants used. For example the temperature can range from about 70° C. to about 150° C., from about 70° C. to about 140° C., from about 70° C. to about 130° C., from about 90° C. to about 130° C., and from about 90° C. to about 120° C. Time for the reaction can be from 2 to 4 hours up to 24 to 48 hours or more, depending upon the temperature, reaction pressure, solvents if used, or catalyst if used. Typically the reaction is conducted under atmospheric pressure; however the reaction may be conducted under pressure or vacuum. The aqueous reaction mixture can optionally include a suitable solvent for carrying out the molybdation reaction. Furthermore, where conditions warrant, a solvent may be used. In general any relatively non-polar, unreactive solvent may be used, such as benzene, toluene, xylene and 1,4-dioxane or mineral oil. Other hydrocarbon and alcohol solvents (e.g., methanol, ethanol) and mixtures may also be employed. Generally water and the nitrogen containing reactant alone will serve as the solvent for the reaction mixture.

The ratio of the nitrogen containing reactant to the acidic molybdenum compound to the salicylate is from about 1:0.1:0.1 to about 1:2.5:2.5. In one embodiment, the ratio is from about 1:0.1:0.1 to about 1:1.5:1.5. In one embodiment, the ratio is from about 1:0.15:0.15 to about 1:1:1. In one embodiment, the ratio is from about 1:0.15:0.15 to about 1:0.75:0.75. In one embodiment, the ratio is from about 1:0.15:0.15 to about 1:0.50:0.50. In one embodiment, the ratio is from about 1:0.15:0.15 to about 1:0.40:0.40. If excess nitrogen containing reactant is used, the remainder that does not react with the acidic molybdenum compound will act as diluent for the product. The entire mixture may be incorporated into the lubricating oil composition.

The molybdenum containing friction modifier of the present invention is oil soluble and/or oil dispersible. Thus, the molybdenum containing friction modifier may advantageously be employed in a lubricating oil composition.

In many instances, it may be advantageous to form concentrates of the lubricating oil soluble additive composition of the present invention within a carrier liquid. These additive concentrates provide a convenient method of handling, transporting, and ultimately blending into lubricant base oils to provide a finished lubricant.

Generally, the lubricating oil soluble additive concentrates of the invention are further blended with additional lubricant base oil stocks and/or additional additives/additive concentrates to provide a finished lubricant. It is desired that the carrier liquid solubilizes or disperses the lubricating additive of the invention and provides an additive concentrate that can be blended into additional lubricant base oil. The present invention therefore further provides an additive concentrate composition comprising an inert carrier fluid and from 2.0% to 90% by weight, based on the total concentrate, of a lubricant additive composition according to the invention. The inert carrier fluid may be a lubricating oil or a suitable hydrocarbon solvent.

These concentrates usually contain from about 2.0% to about 90% by weight, preferably 10% to 50% by weight of the additive composition of this invention and may contain, in addition, one or more other additives known in the art and described below. The remainder of the concentrate is the substantially inert carrier liquid or suitable hydrocarbon solvent.

For finished lubricants, typically the amount of molybdenum containing friction modifier will be from about 0.001 wt % to about 10 wt % based upon the total weight of the lubricating oil composition. Preferably the molybdenum containing friction modifier is employed in an amount from 0.05 wt % to about 5 wt % and even more preferably from about 0.1 wt % to 1.5 wt % based upon the total weight of the lubricating oil composition.

The lubricating oil compositions of the present invention may contain the molybdenum containing friction modifier in an amount providing the composition with at least 10 ppm, at least 20 ppm or at least 40 ppm or molybdenum, based on atoms of molybdenum, in the total mass of the lubricating oil composition. The lubricating oil compositions of the present invention may contain the molybdenum compound in an amount providing the composition with no more than 1000 ppm, no more than 700 ppm or no more than 500 ppm of molybdenum, based on atoms of molybdenum, in the total mass of the lubricating oil composition. Preferred embodiments of the present invention contain the molybdenum containing friction modifier in an amount providing the composition with from 10 to 1000, more preferably from 10 to 700, still more preferably from 10 to 500, ppm by mass of molybdenum, based on atoms of molybdenum, in the total mass of the lubricating oil composition.

The lubricating oil compositions of this invention can be used in the lubrication of essentially any internal combustion engine, including automobile and truck engines, two cycle engines, diesel engines, aviation piston engines, marine and railroad engines and the like. Also contemplated are lubricating oils for gas fired engines, alcohol (e.g. methanol) powered engines, stationery powered engines, industrial engines, turbines, hydraulic systems, transmissions, gears and the like. Particularly useful are heavy duty diesel engines wherein said lubricating oil compositions of this invention can be employed to improve fuel economy and wherein the molybdenum containing friction modifier may provide a friction modifying benefit to the lubricating oil composition.

The lubricating oil composition disclosed herein is used to lubricate an internal combustion engine such as a spark ignition engine, or a compression ignition diesel engine, e.g., a heavy duty diesel engine or a compression ignition diesel engine equipped with at least one of an exhaust gas recirculation (EGR) system; a catalytic converter; and a particulate trap. Such a motor oil composition may be used to lubricate all major moving parts in any reciprocating internal combustion engine, reciprocating compressors and in steam engines of crankcase design. In automotive applications, the motor oil composition may also be used to cool hot engine parts, keep the engine free of rust and deposits, and seal the rings and valves against leakage of combustion gases.

If desired, other additives known in the art may be added to the lubricating oil basestock. Such additives include dispersants, detergents, antiwear agents, extreme pressure agents, antioxidants, rust inhibitors, corrosion inhibitors, pour point depressants, viscosity index improvers, other friction modifiers and the like. Not limiting examples of such are herein below.

The Oil of Lubricating Viscosity

The lubricating oil compositions disclosed herein generally comprise at least one oil of lubricating viscosity. Any base oil known to a skilled artisan can be used as the oil of lubricating viscosity disclosed herein. Some base oils suitable for preparing the lubricating oil compositions have been described in Mortier et al., "*Chemistry and Technology of Lubricants,*" 3rd Edition, London, Springer, Chapters 1 and 2 (2011); and A. Sequeria, Jr., "*Lubricant Base Oil and Wax Processing*," New York, Marcel Decker, Chapter 6, (1994);

and D. V. Brock, *Lubrication Engineering*, Vol. 43, pages 184-5, (1987), all of which are incorporated herein by reference. Generally, the amount of the base oil in the lubricating oil composition may be from about 70 to about 99.5 wt. %, based on the total weight of the lubricating oil composition. In some embodiments, the amount of the base oil in the lubricating oil composition is from about 75 to about 99 wt. %, from about 80 to about 98.5 wt. %, or from about 80 to about 98 wt. %, based on the total weight of the lubricating oil composition.

In certain embodiments, the base oil is or comprises any natural or synthetic lubricating base oil fraction. Some non-limiting examples of synthetic oils include oils, such as polyalphaolefins or PAOs, prepared from the polymerization of at least one alpha-olefin, such as ethylene; and oils or from hydrocarbon synthesis procedures using carbon monoxide and hydrogen gases, such as the Fisher-Tropsch process. In certain embodiments, the base oil comprises less than about 10 wt. % of one or more heavy fractions, based on the total weight of the base oil. A heavy fraction refers to a lube oil fraction having a viscosity of at least about 20 cSt at 100° C. In certain embodiments, the heavy fraction has a viscosity of at least about 25 cSt or at least about 30 cSt at 100° C. In further embodiments, the amount of the one or more heavy fractions in the base oil is less than about 10 wt. %, less than about 5 wt. %, less than about 2.5 wt. %, less than about 1 wt. %, or less than about 0.1 wt. %, based on the total weight of the base oil. In still further embodiments, the base oil comprises no heavy fraction.

In certain embodiments, the lubricating oil compositions comprise a major amount of a base oil of lubricating viscosity. In some embodiments, the base oil has a kinematic viscosity at 100° C. from about 2.5 centistokes (cSt) to about 20 cSt. The kinematic viscosity of the base oils or the lubricating oil compositions disclosed herein can be measured according to ASTM D 445, which is incorporated herein by reference.

In other embodiments, the base oil is or comprises a base stock or blend of base stocks. In further embodiments, the base stocks are manufactured using a variety of different processes including, but not limited to, distillation, solvent refining, hydrogen processing, oligomerization, esterification, and rerefining. In some embodiments, the base stocks comprise a rerefined stock. In further embodiments, the rerefined stock shall be substantially free from materials introduced through manufacturing, contamination, or previous use.

In some embodiments, the base oil comprises one or more of the base stocks in one or more of Groups I-V as specified in the American Petroleum Institute (API) Publication 1509, Seventeenth Edition, September 2012 (i.e., API Base Oil Interchangeability Guidelines for Passenger Car Motor Oils and Diesel Engine Oils), which is incorporated herein by reference. The API guideline defines a base stock as a lubricant component that may be manufactured using a variety of different processes. Groups I, II and III base stocks are mineral oils, each with specific ranges of the amount of saturates, sulfur content and viscosity index. Group IV base stocks are polyalphaolefins (PAO). Group V base stocks include all other base stocks not included in Group I, II, III, or IV.

The saturates levels, sulfur levels and viscosity indices for Group I, II and III base stocks are listed in Table 1 below.

TABLE 1

| Group | Saturates (As determined by ASTM D 2007) | Sulfur (As determined by ASTM D 2270) | Viscosity Index (As determined by ASTM D 4294, ASTM D 4297 or ASTM D 3120) |
|---|---|---|---|
| I | Less than 90% saturates. | Greater than or equal to 0.03% sulfur. | Greater than or equal to 80 and less than 120. |
| II | Greater than or equal to 90% saturates. | Less than 0.03% sulfur. | Greater than or equal to 80 and less than 120. |
| III | Greater than or equal to 90% saturates. | Less than or equal to 0.03% sulfur. | Greater than or equal to 120. |

In some embodiments, the base oil comprises one or more of the base stocks in Group I, II, III, IV, V or a combination thereof. In other embodiments, the base oil comprises one or more of the base stocks in Group II, III, IV or a combination thereof.

The base oil may be selected from the group consisting of natural oils of lubricating viscosity, synthetic oils of lubricating viscosity and mixtures thereof. In some embodiments, the base oil includes base stocks obtained by isomerization of synthetic wax and slack wax, as well as hydrocrackate base stocks produced by hydrocracking (in addition to or instead of solvent extracting) the aromatic and polar components of the crude. In other embodiments, the base oil of lubricating viscosity includes natural oils, such as animal oils, vegetable oils, mineral oils, oils derived from coal or shale, and combinations thereof. Some non-limiting examples of animal oils include bone oil, lanolin, fish oil, lard oil, dolphin oil, seal oil, shark oil, tallow oil, and whale oil. Some non-limiting examples of vegetable oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and meadow foam oil. Such oils may be partially or fully hydrogenated. Some non-limiting examples of mineral oils include Groups I, II, and III base stocks, liquid petroleum oils and solvent treated or acid-treated mineral oils of the paraffinic, naphthenic or mixed paraffinic-naphthenic types. In some embodiments, the mineral oils are neat or low viscosity mineral oils.

In some embodiments, the synthetic oils of lubricating viscosity include hydrocarbon oils and halo-substituted hydrocarbon oils such as polymerized and inter-polymerized olefins, alkylbenzenes, polyphenyls, alkylated diphenyl ethers, alkylated diphenyl sulfides, as well as their derivatives, analogues and homologues thereof, and the like. In other embodiments, the synthetic oils include alkylene oxide polymers, interpolymers, copolymers and derivatives thereof wherein the terminal hydroxyl groups can be modified by esterification, etherification, and the like. In further embodiments, the synthetic oils include the esters of dicarboxylic acids with a variety of alcohols. In certain embodiments, the synthetic oils include esters made from $C_5$ to $C_{12}$ monocarboxylic acids and polyols and polyol ethers. In further embodiments, the synthetic oils include tri-alkyl phosphate ester oils, such as tri-n-butyl phosphate and tri-iso-butyl phosphate.

In some embodiments, the synthetic oils of lubricating viscosity include silicon-based oils (such as the polyalkyl-, polyaryl-, polyalkoxy-, polyaryloxy-siloxane oils and silicate oils). In other embodiments, the synthetic oils include liquid esters of phosphorus-containing acids, polymeric tetrahydrofurans, polyalphaolefins, and the like.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

In further embodiments, the base oil comprises a poly-alpha-olefin (PAO). In general, the poly-alpha-olefins may be derived from an alpha-olefin having from about 2 to about 30, from about 4 to about 20, or from about 6 to about 16 carbon atoms. Non-limiting examples of suitable poly-alpha-olefins include those derived from octene, decene, mixtures thereof, and the like. These poly-alpha-olefins may have a viscosity from about 2 to about 15, from about 3 to about 12, or from about 4 to about 8 centistokes at 100° C. In some instances, the poly-alpha-olefins may be used together with other base oils such as mineral oils.

In further embodiments, the base oil comprises a polyalkylene glycol or a polyalkylene glycol derivative, where the terminal hydroxyl groups of the polyalkylene glycol may be modified by esterification, etherification, acetylation and the like. Non-limiting examples of suitable polyalkylene glycols include polyethylene glycol, polypropylene glycol, polyisopropylene glycol, and combinations thereof. Non-limiting examples of suitable polyalkylene glycol derivatives include ethers of polyalkylene glycols (e.g., methyl ether of polyisopropylene glycol, diphenyl ether of polyethylene glycol, diethyl ether of polypropylene glycol, etc.), mono- and polycarboxylic esters of polyalkylene glycols, and combinations thereof. In some instances, the polyalkylene glycol or polyalkylene glycol derivative may be used together with other base oils such as poly-alpha-olefins and mineral oils.

In further embodiments, the base oil comprises any of the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, and the like) with a variety of alcohols (e.g., butyl alcohol, hexyl alcohol, dodecyl alcohol, 2-ethylhexyl alcohol, ethylene glycol, diethylene glycol monoether, propylene glycol, and the like). Non-limiting examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the like.

In further embodiments, the base oil comprises a hydrocarbon prepared by the Fischer-Tropsch process. The Fischer-Tropsch process prepares hydrocarbons from gases containing hydrogen and carbon monoxide using a Fischer-Tropsch catalyst. These hydrocarbons may require further processing in order to be useful as base oils. For example, the hydrocarbons may be dewaxed, hydroisomerized, and/or hydrocracked using processes known to a person of ordinary skill in the art.

In further embodiments, the base oil comprises an unrefined oil, a refined oil, a rerefined oil, or a mixture thereof. Unrefined oils are those obtained directly from a natural or synthetic source without further purification treatment. Non-limiting examples of unrefined oils include shale oils obtained directly from retorting operations, petroleum oils obtained directly from primary distillation, and ester oils obtained directly from an esterification process and used without further treatment. Refined oils are similar to the unrefined oils except the former have been further treated by one or more purification processes to improve one or more properties. Many such purification processes are known to those skilled in the art such as solvent extraction, secondary distillation, acid or base extraction, filtration, percolation, and the like. Rerefined oils are obtained by applying to refined oils processes similar to those used to obtain refined oils. Such rerefined oils are also known as reclaimed or reprocessed oils and often are additionally treated by processes directed to removal of spent additives and oil breakdown products.

Additional Lubricating Oil Additives

The lubricating oil compositions of the present invention may also contain other conventional additives that can impart or improve any desirable property of the lubricating oil composition in which these additives are dispersed or dissolved. Any additive known to a person of ordinary skill in the art may be used in the lubricating oil compositions disclosed herein. Some suitable additives have been described in Mortier et al., "Chemistry and Technology of Lubricants", 2nd Edition, London, Springer, (1996); and Leslie R. Rudnick, "Lubricant Additives: Chemistry and Applications", New York, Marcel Dekker (2003), both of which are incorporated herein by reference. For example, the lubricating oil compositions can be blended with antioxidants, anti-wear agents, detergents such as metal detergents, rust inhibitors, dehazing agents, demulsifying agents, metal deactivating agents, friction modifiers, pour point depressants, antifoaming agents, co-solvents, package compatibilisers, corrosion-inhibitors, ashless dispersants, dyes, extreme pressure agents and the like and mixtures thereof. A variety of the additives are known and commercially available. These additives, or their analogous compounds, can be employed for the preparation of the lubricating oil compositions of the invention by the usual blending procedures.

In general, the concentration of each of the additives in the lubricating oil composition, when used, may range from about 0.001 wt. % to about 20 wt. %, from about 0.01 wt. % to about 15 wt. %, or from about 0.1 wt. % to about 10 wt. %, based on the total weight of the lubricating oil composition.

Ashless Dispersant

The lubricating oil compositions can contain one or more ashless dispersants containing one or more basic nitrogen atoms. The basic nitrogen compound for use herein must contain basic nitrogen as measured, for example, by ASTM D664 test or D2896. The basic nitrogen compounds are selected from the group consisting of succinimides, polysuccinimides, carboxylic acid amides, hydrocarbyl monoamines, hydrocarbon polyamines, Mannich bases, phosphoramides, thiophosphoramides, phosphonamides, dispersant viscosity index improvers, and mixtures thereof. These basic nitrogen-containing compounds are described below (keeping in mind the reservation that each must have at least one basic nitrogen). Any of the nitrogen-containing compositions may be post-treated with, e.g., boron or ethylene carbonate, using procedures well known in the art so long as the compositions continue to contain basic nitrogen.

Another class of nitrogen-containing compositions useful in preparing the dispersants employed in this invention includes the so-called dispersant viscosity index improvers (VI improvers). These VI improvers are commonly prepared by functionalizing a hydrocarbon polymer, especially a polymer derived from ethylene and/or propylene, optionally containing additional units derived from one or more co-monomers such as alicyclic or aliphatic olefins or diolefins. The functionalization may be carried out by a variety of processes which introduce a reactive site or sites which usually has at least one oxygen atom on the polymer. The polymer is then contacted with a nitrogen-containing source to introduce nitrogen-containing functional groups on the polymer backbone. Commonly used nitrogen sources include any basic nitrogen compound especially those nitrogen-containing compounds and compositions described herein. Preferred nitrogen sources are alkylene amines, such as ethylene amines, alkyl amines, and Mannich bases.

In one embodiment, the basic nitrogen compounds for use in making the dispersants are succinimides, carboxylic acid amides, and Mannich bases. In another preferred embodiment, the basic nitrogen compounds for use in making the dispersants are succinimides having an average molecular weight of about 1000 or about 1300 or about 2300 and mixtures thereof. Such succinimides can be post treated with boron or ethylene carbonate as known in the art.

Generally, the amount of the one or more dispersants in the lubricating oil composition will vary from about 0.05 to about 15 wt. %, based on the total weight of the lubricating oil composition. In another embodiment, the amount of the one or more dispersants will vary from about 0.1 to about 10 wt. %, based on the total weight of the lubricating oil composition.

Antioxidants

The lubricating oil composition of the can contain one or more antioxidants that can reduce or prevent the oxidation of the base oil. Any antioxidant known by a person of ordinary skill in the art may be used in the lubricating oil composition. Non-limiting examples of suitable antioxidants include amine-based antioxidants (e.g., alkyl diphenylamines such as bis-nonylated diphenylamine, bis-octylated diphenylamine, and octylated/butylated diphenylamine, phenyl-α-naphthylamine, alkyl or arylalkyl substituted phenyl-α-naphthylamine, alkylated p-phenylene diamines, tetramethyldiaminodiphenylamine and the like), phenolic antioxidants (e.g., 2-tert-butylphenol, 4-methyl-2,6-di-tert-butylphenol, 2,4,6-tri-tert-butylphenol, 2,6-di-tert-butyl-p-cresol, 2,6-di-tert-butylphenol, 4,4'-methylenebis-(2,6-di-tert-butylphenol), 4,4'-thiobis(6-di-tert-butyl-o-cresol) and the like), sulfur-based antioxidants (e.g., dilauryl-3,3'-thiodipropionate, sulfurized phenolic antioxidants and the like), phosphorous-based antioxidants (e.g., phosphites and the like), zinc dithiophosphate, oil-soluble copper compounds and combinations thereof. The amount of the antioxidant may vary from about 0.01 wt. % to about 10 wt. %, from about 0.05 wt. % to about 5 wt. %, or from about 0.1 wt. % to about 3 wt. %, based on the total weight of the lubricating oil composition.

Detergents

The lubricating oil composition of the present invention can contain a detergent. Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts. A large amount of a metal base may be incorporated by reacting excess metal compound (e.g., an oxide or hydroxide) with an acidic gas (e.g., carbon dioxide).

Detergents that may be used include oil-soluble neutral and overbased sulfonates, borated sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium.

Generally, the amount of the additional detergent can be from about 0.001 wt. % to about 25 wt. %, from about 0.05 wt. % to about 20 wt. %, or from about 0.1 wt. % to about 15 wt. %, based on the total weight of the lubricating oil composition.

Friction Modifiers

In addition to the friction modifier of the present invention, the lubricating oil composition of the present invention can contain additional friction modifiers that can lower the friction between moving parts. Any friction modifier known by a person of ordinary skill in the art may be used in the lubricating oil composition. Non-limiting examples of suitable friction modifiers include fatty carboxylic acids; derivatives (e.g., alcohol, esters, borated esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphonic acids; mono-, di- or tri-alkyl substituted amines; mono- or di-alkyl substituted amides and combinations thereof. In some embodiments examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, or a $C_6$ to $C_{24}$, or a $C_6$ to $C_{20}$, fatty acid ester and a nitrogen-containing compound selected from the group consisting of ammonia, and an alkanolamine and the like and mixtures thereof. The amount of the friction modifier may vary from about 0.01 wt. % to about 10 wt. %, from about 0.05 wt. % to about 5 wt. %, or from about 0.1 wt. % to about 3 wt. %, based on the total weight of the lubricating oil composition.

Antiwear Compounds

The lubricating oil composition of the present invention can contain one or more anti-wear agents that can reduce friction and excessive wear. Any anti-wear agent known by a person of ordinary skill in the art may be used in the lubricating oil composition. Non-limiting examples of suitable anti-wear agents include zinc dithiophosphate, metal (e.g., Pb, Sb, Mo and the like) salts of dithiophosphates, metal (e.g., Zn, Pb, Sb, Mo and the like) salts of dithiocarbamates, metal (e.g., Zn, Pb, Sb and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof. The amount of the anti-wear agent may vary from about 0.01 wt. % to about 5 wt. %, from about 0.05 wt. % to about 3 wt. %, or from about 0.1 wt. % to about 1 wt. %, based on the total weight of the lubricating oil composition.

In certain embodiments, the anti-wear agent is or comprises a dihydrocarbyl dithiophosphate metal salt, such as zinc dialkyl dithiophosphate compounds. The metal of the dihydrocarbyl dithiophosphate metal salt may be an alkali or alkaline earth metal, or aluminum, lead, tin, molybdenum, manganese, nickel or copper. In some embodiments, the metal is zinc. In other embodiments, the alkyl group of the dihydrocarbyl dithiophosphate metal salt has from about 3 to about 22 carbon atoms, from about 3 to about 18 carbon atoms, from about 3 to about 12 carbon atoms, or from about 3 to about 8 carbon atoms. In further embodiments, the alkyl group is linear or branched.

The amount of the dihydrocarbyl dithiophosphate metal salt including the zinc dialkyl dithiophosphate salts in the lubricating oil composition disclosed herein is measured by its phosphorus content. In some embodiments, the phosphorus content of the lubricating oil composition disclosed herein is from about 0.01 wt. % to about 0.14 wt., based on the total weight of the lubricating oil composition.

Foam Inhibitors

The lubricating oil composition of the present invention can contain one or more foam inhibitors or anti-foam inhibitors that can break up foams in oils. Any foam inhibitor or anti-foam known by a person of ordinary skill in the art may be used in the lubricating oil composition. Non-limiting examples of suitable foam inhibitors or anti-foam inhibitors include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof. In some embodiments, the foam inhibitors or anti-foam inhibitors comprises glycerol monostearate, polyglycol palmitate, a trialkyl monothiophosphate, an ester of sulfonated ricinoleic acid, benzoylacetone, methyl salicylate, glycerol monooleate, or glycerol dioleate. The amount of the foam inhibitors or anti-foam inhibitors may vary from about 0.001 wt. % to about 5 wt. %, from about 0.05 wt. % to about 3 wt. %, or from about 0.1 wt. % to about 1 wt. %, based on the total weight of the lubricating oil composition.

Pour Point Depressants

The lubricating oil composition of the present invention can contain one or more pour point depressants that can lower the pour point of the lubricating oil composition. Any pour point depressant known by a person of ordinary skill in the art may be used in the lubricating oil composition. Non-limiting examples of suitable pour point depressants include polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In some embodiments, the pour point depressant comprises an ethylene-vinyl acetate copolymer, a condensate of chlorinated paraffin and phenol, polyalkyl styrene or the like. The amount of the pour point depressant may vary from about 0.01 wt. % to about 10 wt. %, from about 0.05 wt. % to about 5 wt. %, or from about 0.1 wt. % to about 3 wt. %, based on the total weight of the lubricating oil composition.

Demulsifiers

In one embodiment, the lubricating oil composition of the present invention does not contain one or more demulsifiers. In another embodiment, the lubricating oil composition of the present invention can contain one or more demulsifiers that can promote oil-water separation in lubricating oil compositions that are exposed to water or steam. Any demulsifier known by a person of ordinary skill in the art may be used in the lubricating oil composition. Non-limiting examples of suitable demulsifiers include anionic surfactants (e.g., alkyl-naphthalene sulfonates, alkyl benzene sulfonates and the like), nonionic alkoxylated alkyl phenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and combinations thereof. The amount of the demulsifier may vary from about 0.01 wt. % to about 10 wt. %, from about 0.05 wt. % to about 5 wt. %, or from about 0.1 wt. % to about 3 wt. %, based on the total weight of the lubricating oil composition.

Corrosion Inhibitors

The lubricating oil composition of the present invention can contain one or more corrosion inhibitors that can reduce corrosion. Any corrosion inhibitor known by a person of ordinary skill in the art may be used in the lubricating oil composition. Non-limiting examples of suitable corrosion inhibitor include half esters or amides of dodecylsuccinic acid, phosphate esters, thiophosphates, alkyl imidazolines, sarcosines and combinations thereof. The amount of the corrosion inhibitor may vary from about 0.01 wt. % to about 5 wt. %, from about 0.05 wt. % to about 3 wt. %, or from about 0.1 wt. % to about 1 wt. %, based on the total weight of the lubricating oil composition.

Extreme Pressure Agents

The lubricating oil composition of the present invention can contain one or more extreme pressure (EP) agents that can prevent sliding metal surfaces from seizing under conditions of extreme pressure. Any extreme pressure agent known by a person of ordinary skill in the art may be used in the lubricating oil composition. Generally, the extreme pressure agent is a compound that can combine chemically with a metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and combinations thereof. The amount of the extreme pressure agent may vary from about 0.01 wt. % to about 5 wt. %, from about 0.05 wt. % to about 3 wt. %, or from about 0.1 wt. % to about 1 wt. %, based on the total weight of the lubricating oil composition.

Rust Inhibitors

The lubricating oil composition of the present invention can contain one or more rust inhibitors that can inhibit the corrosion of ferrous metal surfaces. Any rust inhibitor known by a person of ordinary skill in the art may be used in the lubricating oil composition. Non-limiting examples of suitable rust inhibitors include nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof. The amount of the rust inhibitor may vary from about 0.01 wt. % to about 10 wt. %, from about 0.05 wt. % to about 5 wt. %, or from about 0.1 wt. % to about 3 wt. %, based on the total weight of the lubricating oil composition.

Multifunctional Additives

The lubricating oil composition of the present invention can contain one or more multifunctional additives. Non-limiting examples of suitable multifunctional additives include sulfurized oxymolybdenum dithiocarbamate, sulfurized oxymolybdenum organophosphorodithioate, oxymolybdenum monoglyceride, oxymolybdenum diethylate amide, amine-molybdenum complex compound, and sulfur-containing molybdenum complex compound.

Viscosity Index Improvers

The lubricating oil composition of the present invention can contain one or more viscosity index improvers. Non-limiting examples of suitable viscosity index improvers include, but are not limited to, olefin copolymers, such as ethylene-propylene copolymers, styrene-isoprene copolymers, hydrated styrene-isoprene copolymers, polybutene, polyisobutylene, polymethacrylates, vinylpyrrolidone and methacrylate copolymers and dispersant type viscosity index improvers. These viscosity modifiers can optionally be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers). Other examples of viscosity modifiers include star polymers (e.g., a star polymer comprising isoprene/styrene/isoprene triblock). Yet other examples of viscosity modifiers include poly alkyl(meth)acrylates of low Brookfield viscosity and high shear stability, functionalized poly alkyl(meth)acrylates with dispersant properties of high Brookfield viscosity and high shear stability, polyisobutylene having a weight average molecular weight ranging from 700 to 2,500 Daltons and mixtures thereof. The amount of the viscosity index improvers may vary from about 0.01 wt. % to about 25 wt. %, from about 0.05 wt. % to about 20 wt. %, or from about 0.3 wt. % to about 15 wt. %, based on the total weight of the lubricating oil composition.

Metal Deactivators

The lubricating oil composition of the present invention can contain one or more metal deactivators. Non-limiting examples of suitable metal deactivators include disalicylidene propylenediamine, triazole derivatives, thiadiazole derivatives, and mercaptobenzimidazoles.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant. Generally, the concentration of each of these additives, when used, may range, unless otherwise specified, from about 0.001 wt. % to about 10 wt. %, in one embodiment from about 0.005 wt. % to about 5 wt. %, or in one embodiment from about 0.1 wt. % to about 2.5 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

The following examples are presented to exemplify embodiments of the invention but are not intended to limit the invention to the specific embodiments set forth. Unless indicated to the contrary, all parts and percentages are by weight. All numerical values are approximate. When numerical ranges are given, it should be understood that embodiments outside the stated ranges may still fall within the scope of the invention. Specific details described in each example should not be construed as necessary features of the invention.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

EXAMPLES

The following examples are intended for illustrative purposes only and do not limit in any way the scope of the present invention.

Example 1

Example Procedure (Mixed molybdate of N,N-bis(2-hydroxyethyl)dodecanamide with Salicylic Acid)

Charged 4.4 grams (30.5 mmol) of $MoO_3$ and 4.21 grams of salicylic acid (30.5 mmol) into the flask with 10.5 grams of water. The mixture was stirred at 95° C. for 30 minutes under a gentle nitrogen blanket. Then N,N-bis(2-hydroxyethyl)dodecanamide (52.3 grams, 171.4 mmol) was added into the reaction flask and the mixture was kept stirring for 1 hour under the same condition. Then the temperature was increased to 110° C. and house vacuum was applied to remove water. After 2 hours at above conditions, the product is a homogenous low viscosity liquid and poured out for performance testing. The Moly content was measured at 5.26 wt %.

Example 2

Mixed molybdate of N,N-bis(2-hydroxyethyl)dodecanamide with Salicylic Acid

Alternate Procedure

Charged 4.4 grams (30.5 mmol) of $MoO_3$ and 4.21 grams of salicylic acid (30.5 mmol) into the flask with 10.5 grams of water and N,N-bis(2-hydroxyethyl)dodecanamide (52.3 grams, 171.4 mmol). The mixture was stirred at 95° C. for 30 minutes under a gentle nitrogen blanket. Then the temperature was increased to 110° C. and house vacuum was applied to remove water. After 2 hours at above conditions, the product is a homogenous low viscosity liquid and poured out for performance testing. The Moly content was measured at 5.0 wt %.

Example 3

Mixed molybdate of N,N-bis(2-hydroxyethyl)dodecanamide with Salicylic Acid

Alternate Procedure

To a 4-neck 250 mL round bottom flask fitted with a condenser, bubbler, thermo probe, and stir blade was added 100 g (330 mmol, 1.0 eq) of N,N-bis(2-hydroxyethyl)dodecanamide, 16.97 g (118 mmol, 0.357 eq) of molybdenum trioxide, 8.97 g (118 mmol, 0.357 eq) salicylic acid, and 40 mL (2.23 mol) water. The reaction mixture was stirred under a weak nitrogen stream while heated at 95° C. for 1 hour before raising the temperature to 110° C.-115° C. with vacuum for 2-3 hours to obtain the product. Molybdenum content was measured at 8.89 wt %.

Example 4

Mixed molybdate of N,N-bis(2-hydroxyethyl)dodecanamide with Salicylic Acid

Alternate Procedure

To a 4-neck 250 mL round bottom flask fitted with a condenser, bubbler, thermo probe, and stir blade was added 100 g (330 mmol, 1.0 eq) of N,N-bis(2-hydroxyethyl)dodecanamide, 8.48 g (59.0 mmol, 0.18 eq) of molybdenum trioxide, 6.12 g (44.3 mmol, 0.13 eq) salicylic acid, and 20 mL (1.12 mol) water. The reaction mixture was stirred under a weak nitrogen stream while heated at 95° C. for 1 hour before raising the temperature to 110° C.-115° C. with vacuum for 2-3 hours to obtain the product. Molybdenum content was measured at 4.65 wt %.

Comparative Example A (Baseline)

A baseline lubricating oil formulation was formed containing ashless dispersants, alkaline earth metal carboxylate, sulfonate, and phenate detergents, zinc dithiophosphate, non-dispersant viscosity index improver, antioxidants, foam inhibitor, and pour point depressant.

Example 5

A lubricating oil composition was prepared by adding 500 ppm of molybdenum of the lubricating oil additive of Example 1 to the lubricating oil formulation in Comparative Example A.

Example 6

Mixed molybdate of 2,2'-(dodecylazanediyl)diethanol with Salicylic Acid

To a 4-neck 250 mL round bottom flask fitted with a condenser, bubbler, thermo probe, and stir blade was added 71.6 g (262 mmol, 1.0 eq) of 2,2'-(dodecylazanediyl)diethanol (Ethomeen C/12), 6.80 g (47.2 mmol, 0.180 eq) of molybdenum trioxide, 6.52 g (47.2 mmol, 0.180 eq) salicylic acid, and 16.0 mL (891 mmol) water. The reaction mixture was stirred under a weak nitrogen stream while heated at 95° C. for 1 hour before raising the temperature to 110° C.-115° C. with vacuum for 2-3 hours. The product is obtained as a thin liquid. Molybdenum content was measured at 5.4 wt %.

Example 7

Mixed molybdate of (Z)-2,2'-(octadec-9-en-1-ylazanediyl)diethanol with Salicylic Acid To a 4-neck 250 mL round bottom flask fitted with a condenser, bubbler, thermo probe, and stir blade was added 93.2 g (262 mmol, 1.0 eq) of (Z)-2,2'-(octadec-9-en-1-ylazanediyl)diethanol (Ethomeen O/12), 6.80 g (47.2 mmol, 0.180 eq) of molybdenum trioxide, 6.52 g (47.2 mmol, 0.180 eq) salicylic acid, and 16.0 mL (891 mmol) water. The reaction mixture was stirred under a weak nitrogen stream while heated at 95° C. for 1 hour before raising the temperature to 110° C.-115° C. with vacuum for 2-3 hours. The product is obtained as a thin liquid. Molybdenum content was measured at 4.2 wt %.

Example 8

Mixed molybdate of N,N-bis(2-hydroxyethyl)oleamide with Salicylic Acid

To a 4-neck 250 mL round bottom flask fitted with a condenser, bubbler, thermo probe, and stir blade was added 96.8 g (262 mmol, 1.0 eq) of N,N-bis(2-hydroxyethyl) oleamide, 6.80 g (47.2 mmol, 0.180 eq) of molybdenum trioxide, 6.52 g (47.2 mmol, 0.180 eq) salicylic acid, and 16.0 mL (891 mmol) water. The reaction mixture was stirred under a weak nitrogen stream while heated at 95° C. for 1 hour before raising the temperature to 110° C.-115° C. with vacuum for 2-3 hours. The product is obtained as a thin liquid. Molybdenum content was measured at 3.46 wt %.

Example 9

Mixed molybdate of N,N-bis(2-hydroxyethyl)dodecanamide with Methyl Salicylate

To a 4-neck 250 mL round bottom flask fitted with a condenser, bubbler, thermo probe, and stir blade was added 100 g (330 mmol, 1.0 eq) of N,N-bis(2-hydroxyethyl)dodecanamide, 8.48 g (59.0 mmol, 0.180 eq) of molybdenum trioxide, 8.97 g (59.0 mmol, 0.180 eq) methyl salicylate, and 20.1 mL (1.12 mol) water. The reaction mixture was stirred under a weak nitrogen stream while heated at 95° C. for 1 hour before raising the temperature to 110° C.-115° C. with vacuum for 2-3 hours. The product is obtained as a thin liquid. Molybdenum content was measured at 4.19 wt %.

Example 10

A lubricating oil composition was prepared by adding 500 ppm of molybdenum of the lubricating oil additive of Example 9 to the lubricating oil formulation in Comparative Example A.

Example 11

Mixed molybdate of N,N-bis(2-hydroxyethyl)dodecanamide with 3,5-diisopropyl-2-hydroxybenzoic Acid To a 4-neck 250 mL round bottom flask fitted with a condenser, bubbler, thermo probe, and stir blade was added 100 g (330 mmol, 1.0 eq) of N,N-bis(2-hydroxyethyl)dodecanamide, 8.48 g (59.0 mmol, 0.180 eq) of molybdenum trioxide, 13.12 g (59.0 mmol, 0.180 eq) 3,5-diisopropyl-2-hydroxybenzoic acid, and 20.1 mL (1.12 mol) water. The reaction mixture was stirred under a weak nitrogen stream while heated at 95° C. for 1 hour before raising the temperature to 110° C.-115° C. with vacuum for 2-3 hours. The product is obtained as a viscous liquid. Molybdenum content was measured at 3.6 wt %.

Comparative Example B

A lubricating oil composition was prepared by adding 500 ppm of molybdenum as molybdenum dithiocarbamate (MoDTC), available from AdekaUSA Corporation, Saddle River, N.J.) to the lubricating oil formulation in Comparative Example A.

Comparative Example C

A lubricating oil composition was prepared by adding 500 ppm of molybdenum oxysulfide succinimide complex, derived from a polyisobutenyl (having an average molecular weight of 1000) succinimide, as described in Ruhe et al, U.S. Pat. No. 6,962,896 to lubricating oil formulation in Comparative Example A.

Comparative Example D

A lubricating oil composition was prepared by adding 500 ppm of molybdenum oxysulfide succinimide complex, derived from a polyisobutenyl (having an average molecular weight of 1000) succinimide, as described in King et al, U.S. Pat. No. 4,263,152 to lubricating oil formulation in Comparative Example A.

Friction Performance

High Frequency Reciprocating Rig (HFRR) Evaluation

The compositions described above were tested for friction performance in a HFRR bench test from 120° C. to 180° C.

The friction performance of the lubricating oil composition of Example 5 and Example 10 were evaluated using a High Frequency Reciprocating Rig (HFRR), and compared to the friction performance of the lubricating oil composition of Comparative Example A (baseline), Comparative Example B, Comparative Example C, and Comparative Example D.

The HFRR test rig is an industry recognized tribometer for determining lubricant performance. The PCS instrument uses an electromagnetic vibrator to oscillate a specimen (the ball) over a small amplitude while pressing it against a fixed specimen (a flat disk). The amplitude and frequency of the oscillation and the load are variable. The frictional force between the ball and flat and the electrical contact resistance (ECR) are measured. The flat, stationary specimen is held in a bath to which the lubricating oil is added, and can be heated. For this test, the tribometer was set up to run at 20 Hz for 20 minutes, using 6 mm ball on flat specimens of 52100 steel. The load was 1 kg and temperature was conducted at 120° C., 140° C., 160° C., and 180° C. The lubricating oils were pretreated with about 6% by weight, based on the total weight of lubricating oil, of diesel engine soot collected from diesel engine exhaust. The soot was stirred into the oil to wet it and then homogenized for 15 minutes prior to testing. In this test, a smaller coefficient of friction corresponds to a more effective lubricating friction modifier additive. The HFRR friction performance data are represented in Table 2.

TABLE 2

HFRR Wear and Friction Performance Results
Comparison of Coefficients of Friction (COF) for Various Examples

| Temperature | Example 5 | Example 10 | Comp. Example A (Baseline) | Comp. Example B | Comp. Example C | Comp. Example D |
|---|---|---|---|---|---|---|
| 120° C. | 0.09 | 0.118 | 0.187 | 0.087 | 0.16 | 0.181 |
| 140° C. | 0.059 | 0.068 | 0.19 | 0.118 | 0.167 | 0.191 |
| 160° C. | 0.05 | 0.051 | 0.19 | 0.129 | 0.179 | 0.193 |
| 180° C. | 0.071 | 0.076 | 0.191 | 0.126 | 0.151 | 0.171 |

Example 5 and Example 10 in Table 2 show that the coefficient of friction (COF) (wherein the lower the COF, the better the friction reducing properties) of the lubricating oil composition of the present disclosure is superior to that of molybdenum dithiocarbamate (Comp. Example B), a well-known friction reducer, at temperatures from 120° C. to 180° C. Example 5 and Example 9 also show superior friction reducing properties as compared to a molybdenum succinimide complex synthesized from a polyisobutenyl succinimide wherein the polyisobutenyl group has around 1000 molecular weight equivalent of carbon atoms (Comp. Examples C and D). As evidenced by the data in Table 2, friction reducing properties are improved when a molybdate of a dialkanol amide/amine and salicylate is employed.

What is claimed is:

1. A method for preparing a molybdenum containing friction modifier comprising, forming a aqueous reaction mixture comprising:

(a) a nitrogen containing reactant comprising a compound having the formula (I) and/or formula (III), (Formula I)

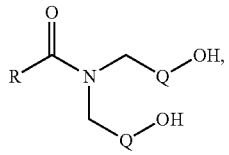

(Formula III)

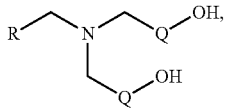

wherein each R individually comprises 1 to 30 carbon atoms and Q is a $C_1$ to $C_4$ linear or branched alkylene group, (b) an acidic molybdenum compound; and (c) a salicylate compound having the formula (V);

(Formula V)

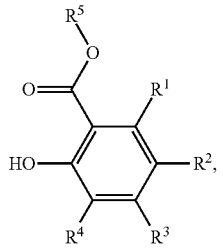

wherein $R^1$, $R^2$, $R^3$, and $R^4$ are each independently selected from the group consisting of: hydrogen atom, $C_1$-$C_{40}$ alkyl group, carbocyclic group, heterocyclic group, nitro group, alkoxy group, hydroxy group, nitrile group, thiol group, amide group, amino group, keto group, and ester group; $R^5$ is a hydrogen atom or $C_1$-$C_{18}$ alkyl group; for a time and temperature sufficient to form said molybdenum containing friction modifier.

2. The method of claim 1, wherein the reaction temperature to form the molybdenum containing friction modifier is about 70° C. to about 150° C.

3. The method of claim 2, wherein the ratio of the nitrogen containing reactant to the acidic molybdenum compound to the salicylate compound is from about 1:0.1:0.1 to about 1:2.5:2.5 respectively.

4. The method of claim 2, wherein the acidic molybdenum compound is selected from the group consisting of molybdic acid, ammonium molybdate, sodium molybdate, potassium molybdates, hydrogen sodium molybdate, $MoOCl_4$, $MoO_2Br_2$, $Mo_2O_3Cl_6$, molybdenum trioxide, and mixtures thereof.

5. The method of claim 2, wherein the amount of molybdenum atoms in the molybdenum containing friction modifier is 0.1% to 20%.

6. The method of claim 2, wherein the amount of molybdenum atoms in the molybdenum containing friction modifier is about 3.0% to about 9.0%.

7. The method of claim 2, wherein the amount of molybdenum atoms in the molybdenum containing friction modifier is about 4.0% to about 6.0%.

* * * * *